US005924619A

United States Patent [19]

Bartell

[11] Patent Number: 5,924,619

[45] **Date of Patent: *Jul. 20, 1999**

[54] METHOD AND APPARATUS FOR PASSING A PRINTED WEB BETWEEN THE SEPARATED CYLINDERS OF A DEACTIVATED PRINTING UNIT OF A WEB FED ROTARY PRINTING PRESS

[75] Inventor: Ronald Arthur Bartell, Madbury, N.H.

[73] Assignees: Heidelberg Harris Inc., Dover, N.H.; Heidelberger Druckmaschinen AG, Heidelberg, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/911,997

[22] Filed: Aug. 15, 1997

Related U.S. Application Data

[63] Continuation of application No. 08/595,991, Feb. 9, 1996, abandoned.

[51] Int. Cl.[6] ..... B65H 20/14; B65H 23/04

[52] U.S. Cl. ..... 226/7; 226/97.3; 242/615.11

[58] Field of Search ..... 226/7, 97, 196, 226/97.1, 97.3; 242/615.11

[56] References Cited

U.S. PATENT DOCUMENTS

| | | | |
|---|---|---|---|
| 4,285,452 | 8/1981 | Reba et al. | 226/7 |
| 5,036,737 | 8/1991 | Glaser | 83/100 |
| 5,162,630 | 11/1992 | Iwasaki | 226/97 |

FOREIGN PATENT DOCUMENTS

| | | | |
|---|---|---|---|
| 82 22098 | 7/1983 | France . | |
| 98677 | 8/1898 | Germany . | |
| 1129965 | 5/1962 | Germany . | |
| 1183665 | 12/1964 | Germany | 226/97 |
| 1586320 | 6/1970 | Germany . | |
| 2120805 | 11/1972 | Germany | 226/97 |
| 2150986 | 4/1973 | Germany . | |
| 28 22 137 | 11/1979 | Germany . | |
| 3706541 | 9/1988 | Germany | 226/97 |
| 3706542 | 9/1988 | Germany | 226/97 |
| 3739338 | 6/1989 | Germany | 226/97 |
| 41 13 465 | 10/1992 | Germany . | |
| 0115546 | 9/1980 | Japan | 226/97 |
| 0277542 | 12/1986 | Japan | 226/97 |
| 3125623 | 5/1988 | Japan | 226/7 |
| 0209257 | 8/1989 | Japan | 226/97 |
| 660332 A5 | 4/1987 | Switzerland | B41F 7/20 |
| 1006052 | 9/1965 | United Kingdom | 226/97 |
| 1461572 | 1/1977 | United Kingdom . | |
| 1 255 079 | 3/1995 | United Kingdom . | |

*Primary Examiner*—Rodney H. Bonck
*Assistant Examiner*—Matthew A. Kaness
*Attorney, Agent, or Firm*—Burns, Doane, Swecker & Mathis, LLP

[57] ABSTRACT

A method and apparatus are provided for passing a printed web through the separated printing or blanket cylinders of a motionless downstream printing unit of a lithographic rotary printing press. First and second blast air devices are arranged on the first and second sides of the web, directing blast air into respective spaces formed between the running web and the cylinders, at a position located upstream of the cylinders. The blast air applies forces to both sides of the running web to thereby center the web on a path which is similar to the path taken by the web through the blanket cylinders during normal printing operation.

21 Claims, 5 Drawing Sheets

20
24
34
22
32
2
4
16
18
6
8
14
28
26
12
10

METHOD AND APPARATUS FOR PASSING A PRINTED WEB BETWEEN THE SEPARATED CYLINDERS OF A DEACTIVATED PRINTING UNIT OF A WEB FED ROTARY PRINTING PRESS

This application is a continuation of application No. 08/595,991, filed Feb. 9, 1996 and now abandoned.

BACKGROUND OF THE INVENTION

1. Field of the Invention

The present invention is related to an apparatus for passing a printed web between the separated cylinders of a deactivated printing unit of a web fed rotary printing press.

2. State of the Art

For producing high quality, high volume multicolor printed products, web fed rotary printing presses are used with two or more (e.g., four) printing units, each applying a different color to an endless web running through the printing press. When processing products which do not require the use of all printing units, (e. g., if only one color is used for a product, but the printing press comprises four printing units), it is desired to switch off the unused printing units in order to save costs and energy and to reduce the noise which is produced by the printing press.

It is possible to move the blanket or corresponding blanket cylinders which transfer the image from the plate cylinders onto the web, away from the web within the unused printing unit. However, there are several reasons why it is not easily possible to simply move the blanket cylinders away from each other and switch off the printing unit, so that the web which was already printed in upstream printing units can pass through the separated blanket cylinders of a motionless press. For example, a first reason is that the blanket cylinders are arranged inclined relative to the vertical such that an axis extending through the centers of two adjacent blanket cylinders is inclined towards the vertical by an angle of inclination of, for example, 10° to 15° while the web runs horizontally. Inclining the cylinders has the advantage that the web not only contacts the cylinders on a small contacting line, but wraps around a certain circumferential portion of each of the blanket cylinders, to stabilize the web and create a better pinch point. In addition, the inclination of the cylinders provides a consistent "peal off" of the web from the blanket cylinders.

A second reason it is not easily possible to simply move the blanket cylinders away from one another is that in most of the web fed printing presses in which the web is printed by two corresponding blanket cylinders on both sides, one of the blanket cylinders is usually immovably arranged in the printing unit in order to serve as a reference point, and only the other cylinder is moved when a separation of the cylinders is desired. Furthermore, due to the construction of the mechanical driving mechanism for moving the blanket cylinders apart from each other, it is often not possible to separate the cylinders more than about 2 mm to 4 mm from each other.

A third reason it is not easily possible to simply move the blanket cylinders away from one another is that the running web is subject to strong vibrations and fluttering. Thus, even if a gap of about 4 mm would be large enough to theoretically allow a free passing of the web through the separated inclined cylinders, the wet printed web would inevitably touch the surface of the cylinders, thereby dramatically reducing printing quality and increasing the danger of web breaks.

In order to deactivate one or more printing units in a lithographic printing press used for the production of high quality prints, the ink flow from the ink trays to the plate cylinders of a respective printing unit is interrupted, the printing plates on the plate cylinders are replaced by blank plates and the plate and blanket cylinders are afterwards driven at the usual web speed, whereby the web is in contact with the respective blanket cylinder and the dampening system is switched on. Alternately, the web can be diverted around the deactivated printing unit or printing units using, for example, air-operated blower bars or angle bars. However, using a diversion or by-passing of the printed web around the deactivated printing units has the disadvantage that for every new printing job in which the deactivated printing units have to be activated again, the endless web has to be threaded in the respective printing unit. Besides this, the diversion of the web around the deactivated printing unit is likely to cause a misregistering of the web, particularly if non-marking web floatation devices such as air bars are used. Further, the use of a diversion also requires a retiming of the printing units when they are removed from the web path.

Another possible technique to pass the web between the separated cylinders of a deactivated, motionless printing unit, is to guide the web over rigidly mounted grater rollers which are located upstream and downstream of a deactivated printing unit. However, grater rollers can produce unacceptable damage to not only the wet surface of a printed web, but also to the surface of an unprinted web in a lithographic printing press. Further, grater rollers can significantly increase the danger of web breaks as a result of their rigid mounting. Thus, grater rollers are typically only used in low quality newspaper printing presses.

U.K. Patent Specification 1 461 572 describes an apparatus for assisting in the guidance of the leading end of a moving flexible web which includes two curved arrangements of air nozzles located above and below the web path and arranged to converge towards the nip of cutter rollers of a subsequent cutting section. The jets of air produced by the air nozzles are directed towards the web path and are preferably concentrated towards the nip. The apparatus is only intended for use in threading a flexible web through the nips of a printing press or an auxiliary device, such as a cutter, a folder or a slitter which is not in operation.

German patent application DE-OS 28 22 137 describes an apparatus similar to that of the U.K. Patent Specification which serves as a threading and guiding aid for assisting in guidance of the leading end of a moving flexible web into the nip formed between two cutting cylinders of a subsequent cutting section. The apparatus comprises two blast air nozzles which blow air in a direction towards the nip, thereby centering the leading end of the paper web and preventing the web from moving sideward.

SUMMARY OF THE INVENTION

Having discussed the state of the art and its disadvantages, it is accordingly an object of the present invention to provide an apparatus which provides a safe and secure passing of a printed or coated, but undryed web of paper or other substrate, between the separated blanket or coating cylinders of a silent and motionless deactivated downstream printing unit.

It is another object of the invention to provide an apparatus which reduces web flutter of the running web as it passes through the separated blanket cylinders or coating cylinders of an unused printing or coating unit.

Exemplary embodiments of the present invention provide a quick and easy changing of printing jobs, particularly when changing from multi-color jobs to single-color jobs, because it is not necessary to separate the web and divert it over unused and motionless printing units. When using exemplary embodiments according to the present invention, the switching off of a previously used printing unit for a new printing job is easily achieved by switching on the blast air provided through blast air nozzles and separating the corresponding blanket cylinders of the respective printing unit.

Another advantage of the invention is that the amplitude of the swinging of a running web which passes through a motionless printing unit is reduced, since exemplary embodiments of an apparatus according to the invention apply forces to both sides of the printed or coated web at once. The reduction of the amplitude of transversal swinging further stabilizes the web over the long span between three printing or coating units and reduces the amount that the blanket or coating cylinders need to be separated from each other to allow free passing of the printed web.

A further advantage of the invention is that there is no misregistering owing to the diversion of the web around a motionless printing unit via non-marking web floatation devices such as air bars. Besides this, there is hardly any retiming of the printing units required when one unit is removed from the printing path since, as it has been found by the applicant, the travel path taken by the web or substrate through a deactivated printing unit corresponds closely to the path during normal printing or coating.

BRIEF DESCRIPTION OF THE DRAWINGS

The above-mentioned and other objects, features and advantages of the present invention will become more apparent by referring to the following description of preferred embodiments of the invention taken in conjunction with the accompanying drawings. In the drawings.

DETAILED DESCRIPTION OF THE PREFERRED EMBODIMENTS

Figure 1:
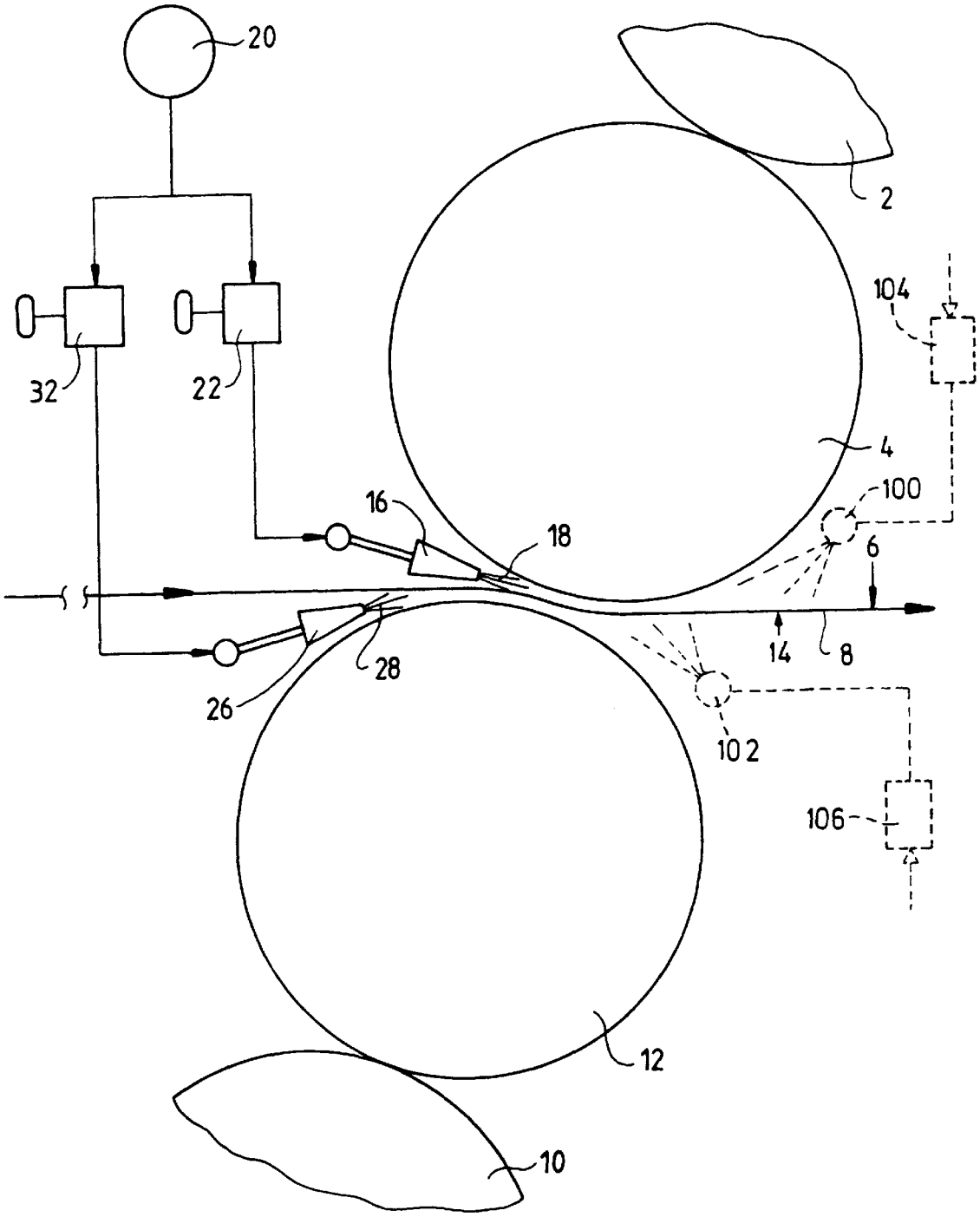
FIG. 1 shows a schematic cross-sectional view of an embodiment of the present invention.

Referring now to the drawings and, particularly to FIG. 1, there is shown a first plate cylinder 2 and a corresponding first printing or blanket cylinder 4 of a printing unit for printing on a first side 6 of a web 8 passing through the printing unit. As shown in FIG. 1 there is a second plate cylinder 10 and a corresponding second printing or blanket cylinder 12 located on the second side 14 of the web 8 for printing both sides of a web simultaneously. As it can be seen from FIG. 1, the cylinders 2, 4, 10 and 12 are slightly inclined towards the vertical by about 10° to 15°, so that the running web 8 has a certain amount of wrap around each of the cylinders 4 and 12, thereby creating a consistent "peal off" of the web from the blanket cylinders 4, 12, stabilizing the web and creating a better pinch point for controlling web tension. Since the mechanical separation means for moving the cylinders 4 and 12 apart from each other can be based on an eccentric mechanism, a separation of the cylinders 4 and 12 is typically limited to no more than about 2 mm to 4 mm. Further, one of the blanket cylinders is typically in a fixed position in the side frame in order to serve as a reference point. Thus, the web cannot pass the gap formed between the two separated cylinders 4 and 12 on a straight line without contacting the surfaces of the cylinders 4 and 12.

As can be seen from FIG. 1, a first blast air means 16 is located upstream of the first cylinder 4 on the first side 6 of the web 8 and supplies blast air 18 into the space formed between the first cylinder 4 and the first side 6 of the web 8. For controlling the amount of blast air 18, the first blast air means 16 is connected to a compressed-air reservoir 20 via, for example, a solenoid valve 22 or another equivalent valve which is controlled by a central control unit 24 (see FIG. 2) or by hand.

A second blast air means 26 is located upstream of the second cylinder 12 on the second side 14 of the web 8 and supplies blast air 28 from, for example, the compressed-air reservoir 20 or from a separate compressed-air reservoir (not shown in FIG. 1) into a space formed between the second cylinder 12 and the second side 14 of the running web 8.

For controlling the amount of blast air 28 supplied into the space formed between the second side 14 of the web 8 and the second cylinder 12, the second blast air means 26 can be connected to the compressed-air reservoir 20 or to the separate, compressed-air reservoir via a solenoid valve 32 or an equivalent valve which is controlled by the central control unit 24 (FIG. 2) or by hand.

Figure 5:
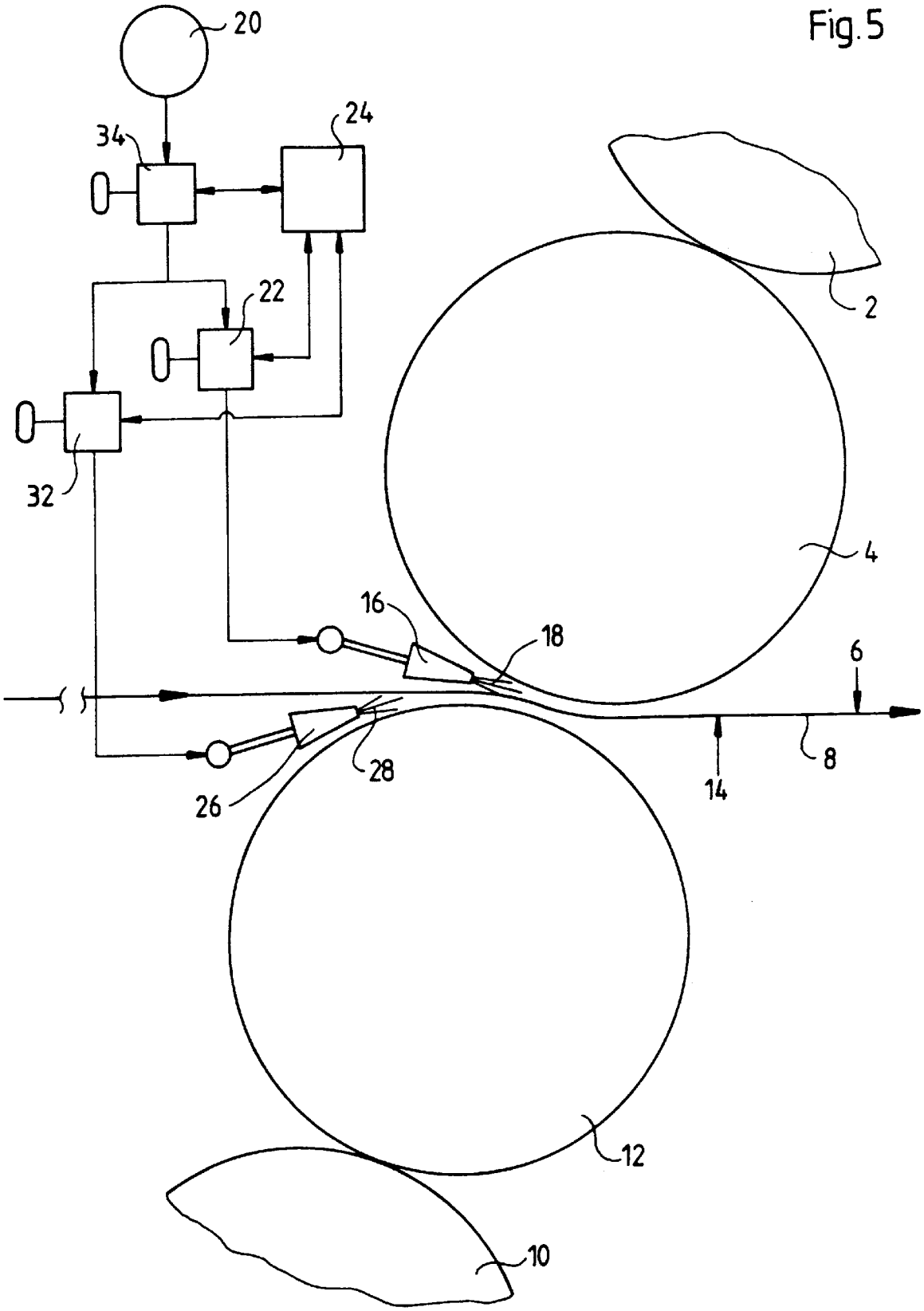
FIG. 5 shows a schematic view of a solenoid valve arrangement which can, for example, be used in the embodiment of FIG. 2.

As shown in FIG. 5 the first and second blast air means 16 and 26 can further be connected to a common compressed-air reservoir such as the compressed-air reservoir 20, via a third solenoid valve 34, arranged between the compressed-air reservoir 20 and the valves 22 and 32. The third solenoid valve 34 can also be controlled by the central control unit 24 or by hand, and provides for easily and quickly switching the blast air 18 and 28 of the first and second blast air means 16 and 26 on or off, or for regulating the blast air without altering the adjustment of the valves 22 and 32.

The blast air 18 supplied to the space formed between the first side 6 of the web 8 and the first cylinder 4 of the printing unit as well as the blast air 28 supplied to the space formed between the second side 14 of the web 8 and the second cylinder 12 of the printing unit can be controlled such that it is sufficiently high across the entire width of the web 8 to float the web 8, but that it is on the other hand low enough to prevent instability or a fluttering of the running web 8 passing between the separated cylinders 4 and 12 of the printing unit. The pressure can be established by trial and error during a set up phase of the printing unit, taking the weight of the web into consideration.

The blast air 18 and 28 supplied by the first and second blast air means 16 and 26 provides an air flow between the web 8 and the surface of the respective first and second cylinders 4 and 12. The air flow prevents the running web 8 from contacting the cylinders 4 and 12, thus eliminating marking of the printed or coated web 8.

In an exemplary embodiment of the invention, the blast air 18, 28 is directed at a contacting point between the running web 8 and the respective first and second cylinders 4 and 12, applying forces to both sides of the web 8 which center the web 8 in the middle of the gap formed between the two separated cylinders 4 and 12. The path which the running web 8 follows between the two separated cylinders 4 and 12 has been found to be similar to the path taken by the web or substrate during normal printing or coating operation of the printing unit. Therefore, the deflection of the web 8 and the resulting requirement for compensating the deflection and retiming of the printing unit, as well as the potential for loss of registration, is minimized.

Figure 2:
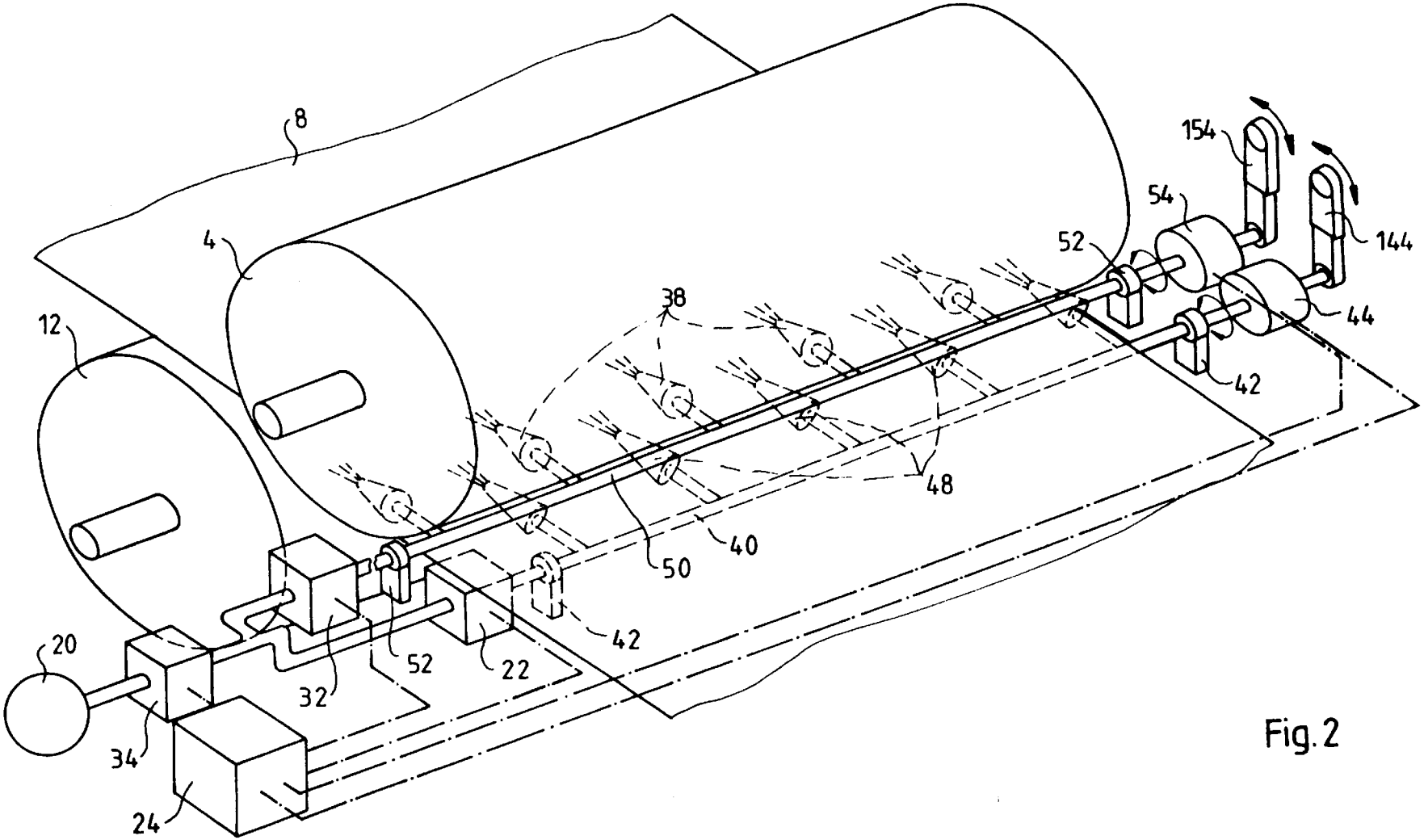
FIG. 2 shows a perspective view of the FIG. 1 embodiment of the invention in which first and second blast air means are formed by an arrangement of adjacent nozzles.

As shown in FIG. 2, the first blast air means 16 can be formed of a first arrangement of nozzles 38 which are connected to a first conduit, such as a hose, pipe or manifold 50. Similarly, the second blast air means 26 can be formed of a second arrangement of nozzles 48 which are connected to a second hose, pipe or manifold 40.

Figure 3:
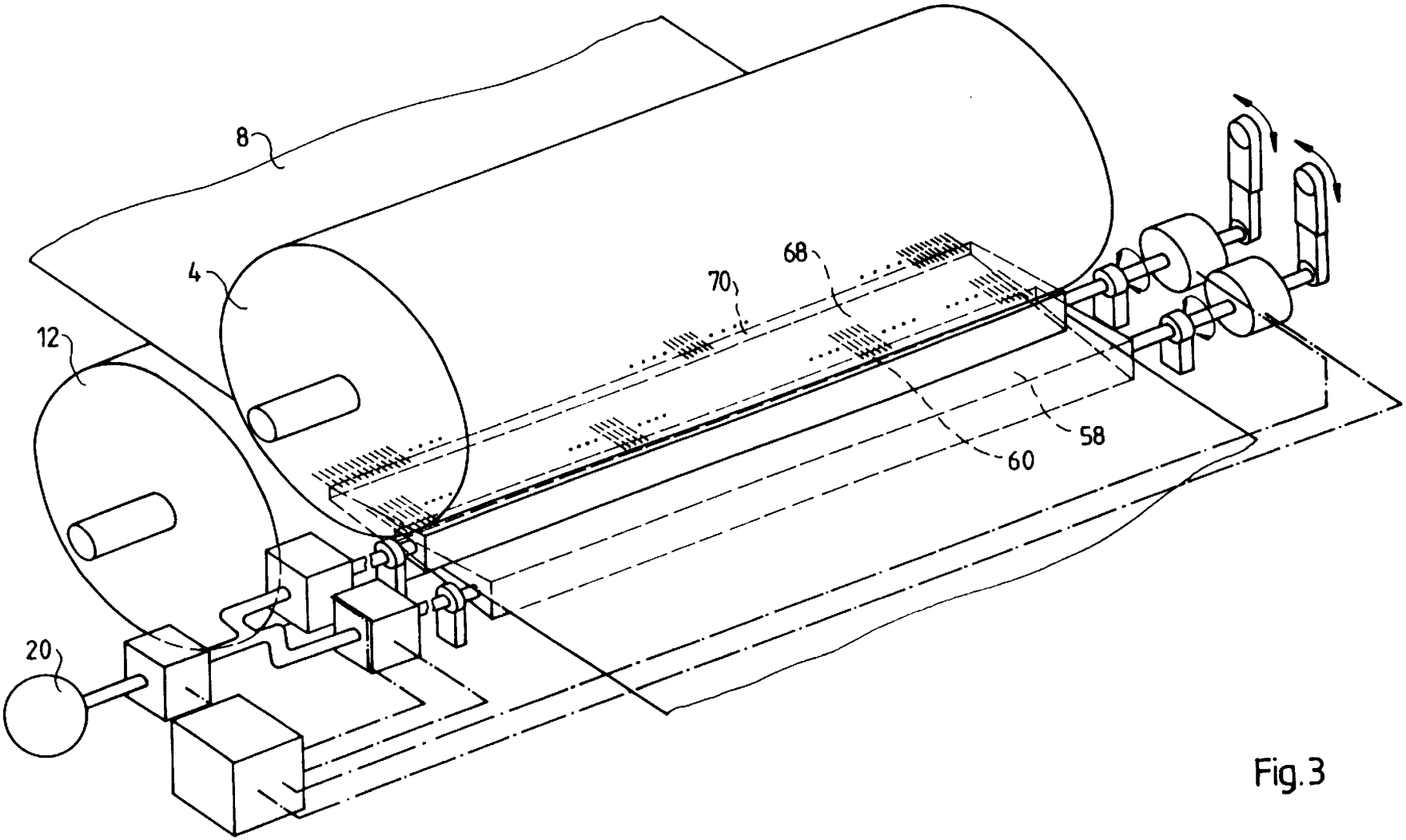
FIG. 3 shows a perspective side view of another embodiment in which the first and second blast air means comprise an air nozzle with an elongated nozzle opening extending transversely across the width of a web.
Figure 4:
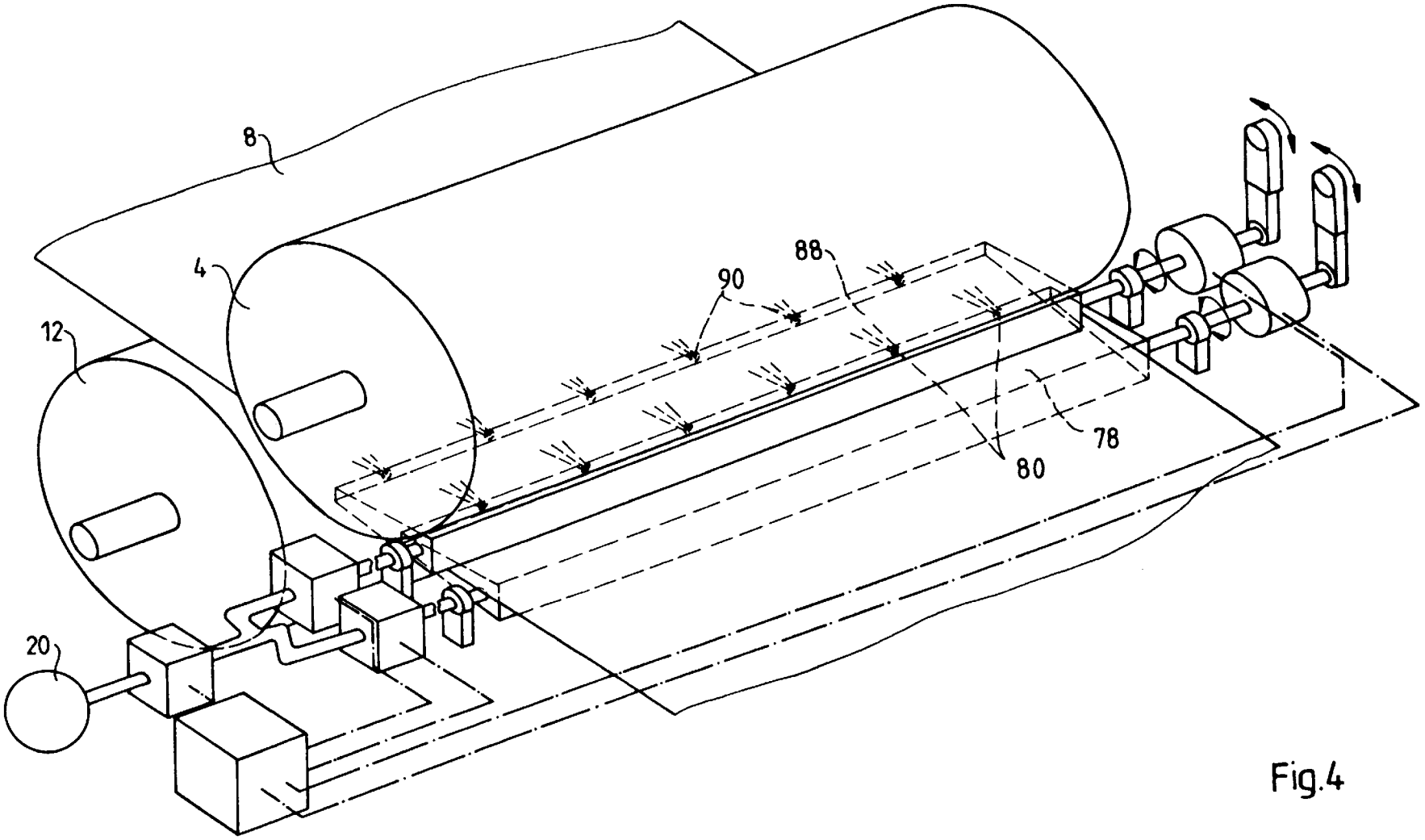
FIG. 4 shows a perspective side view of another embodiment of the invention, in which the first and a second blast air means comprise a blower bar with separate adjacent air nozzles.

The manifolds 40 and 50 can be rotatably mounted in respective first and second supports 42 and 52 as shown in FIGS. 2 to 4, whereby the axes of rotation are essentially parallel to the axes of the first and second cylinders 4 and 12. The manifolds 40 and 50 can further be connected with their one end to a respective first and second driving means 44 and 54, such as an electric motor or pneumatic drive which is controlled by the central control unit 24. As shown in FIGS. 2 to 4, the manifolds 40 and 50 can alternately, or additionally, be connected to a respective lever 144 and 154 for rotating the manifolds 40 and 50 by hand.

The other end of each of the manifolds 40 and 50 can be connected to the compressed air reservoir 20 via the valves 22, 32 and/or 34 as described with respect the exemplary embodiment of FIG. 1.

By activating the motors 44 and 54 and/or the levers 144 and 154, the first and second arrangement of nozzles 38 and 48 of the first and second blast air means 16 and 26 can be rotated for adjusting the direction in which the blast air 18 and 28 is directed, thereby correcting the path of the web 8 through the separated cylinders 4 and 12 of a motionless, deactivated printing unit of a web fed rotary printing press. In an exemplary embodiment of the invention, the nozzles 38 and 48 are cone shaped. The number of nozzles 38 and 48 of the first and second arrangements depends on the width of the web and is not limited to the five nozzles 38, 48 shown for each side of the web in FIG. 2.

Instead of using an arrangement of multiple adjacent nozzles 38 and 48 as shown in FIG. 2, each of the first and second blast air means 16 and 26 can alternately be formed of a single air nozzle 58 and 68 respectively (FIG. 3), each comprising elongated nozzle openings 60 and 70, extending in a direction essentially parallel to the first and second cylinders 4 and 12 of the printing unit as shown for example in FIG. 3. Instead of using a single air nozzle 58, 68 with each of elongated openings 60, 70, there can be used an arrangement of several nozzles with elongated openings, which are not shown in the drawings.

In the exemplary embodiment of FIG. 4, the nozzles 58 and 68 of FIG. 3 have been replaced by first and second blower bars 78 and 88 respectively, each of the blower bars having a plurality of separate nozzles 80 and 90.

The air nozzles 58 and 70 of the embodiment shown in FIG. 3 and the blower bars 78 and 88 of FIG. 4 can be rotated by the rotating means 44, 144 and 54, 154, and can each be connected to a compressed-air reservoir 20 in the same way as described with respect to the manifolds 40 and 50 of the exemplary embodiment shown in FIG. 2.

The air nozzles 58 and 68 (FIG. 3) and the blower bars 78 and 88 (FIG. 4) can be tapered towards the space formed between the web 8 and the first and second cylinders 4, 12 respectively. Such a feature can be used to extend the openings 60 and 70 of the air nozzles 58 and 68 (FIG. 3) and nozzles 80 and 90 of the blower bars 78 and 88 (FIG. 4) further into the space formed between the web 8 and the respective cylinders 4 and 12, thereby reducing the amount of blast air which must be supplied to the first and second blast air means to achieve a centering of the web between the cylinders 4 and 12.

Although not shown in the drawings, those skilled in the art will appreciate that one type of blast air means, such as the blower bars 58, 68 or 78, 88 on the first side of the web 8 can be combined with a second different type of blast air means, such as the separate nozzles 38, 48 on the second side of the web 8, or that any other combination of different blast air means can be used.

As shown in FIG. 1, it can further be useful to arrange an additional blast air means 100, 102 formed, for example, in the same way as one of the blast air means 16, 26 described above and shown in FIGS. 2 to 4, or formed as any conventional air bar or the like, downstream of the blanket cylinders 4, 12 on the first side 6 and/or on the second side 14 of the web 8. Such a feature can be used to manipulate the air stream passing through the separated cylinders 4, 12 on the downstream side of the cylinders 4 and 12.

The downstream blast air means 100, 102 can be connected to a compressed-air reservoir, such as the compressed-air reservoir 20 of FIG. 1, via controllable valves 104, 106. The downstream blast air means can be used to supply blast air in a direction towards the running web 8 and/or towards the gap formed between the respective first or second side 6, 14 of the web 8 and the respective cylinder 4, 12. The downstream blast air means 100, 102 can further be rotatably mounted in the same way as the blast air means 16, 26, such as in supports similar to the supports 42 and 52 shown in FIGS. 2 to 4, such that the direction of the blast air is easily adjusted manually and/or automatically.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. Method for passing a printed web between first and second blanket cylinders of a printing unit of a web fed rotary printing press, comprising the steps of:

separating said first and second blanket cylinders from a web print position;

supplying blast air into a first space formed between a first side of the web and the first blanket cylinder of a printing unit of a web fed rotary printing unit so said web does not contact said first blanket cylinder;

supplying blast air into a second space formed between a second side of the web and the second blanket cylinder so said web does not contact said second blanket cylinder; and repositioning said first and second blanket cylinders to a position for printing said web.

2. A printing press for printing on a running web, comprising:

a printing unit including first and second blanket cylinders, said first and second blanket cylinders being inclined towards vertical and being separable from each other, said printing unit further including a first blast air means, located on a first side of the web, facing said first blanket cylinder and supplying bast air into a first space formed between the first side of the web and the first blanket cylinder when the first and second blanket cylinders are separated; and a second blast air means, located on a second side of the web facing said second blanket cylinder and supplying blast air into a second space formed between the second side of the web and said second blanket cylinder when the first and second blanket cylinders are separated.

3. Apparatus according to claim 2, wherein the first blast air means further comprises:

at least one blast air nozzle.

4. Apparatus according to claim 3, wherein the blast air nozzle of the first blast air means is tapered towards the first space formed between the first blanket cylinder and the first side of the web.

5. Apparatus according to claim 3, wherein the at least one blast air nozzle of the first blast air means further comprises:

an elongated nozzle opening extending in a direction essentially transversely to a running direction of the web.

6. Apparatus according to claim 3, wherein the second blast air means further comprises:

at least one blast air nozzle.

7. Apparatus according to claim 6, wherein the at least one blast air nozzle of the second blast air means is tapered towards the second space formed between the second blanket cylinder and the second side of the web.

8. Apparatus according to claim 6, wherein the at least one blast air nozzle of the second blast air means further comprises:

a elongated nozzle opening extending in a direction essentially transversely to a running direction of the web.

9. Apparatus according to claim 3, wherein the second blast air means further comprises:

a blower bar.

10. Apparatus according to claim 9, wherein the blower bar of the second blast air means is tapered towards the second space formed between the second blanket cylinder and the second side of the web.

11. Apparatus according to claim 2, wherein the first blast air means further comprises:

a blower bar.

12. Apparatus according to claim 11, wherein the blower bar is tapered towards the first space formed between the first blanket cylinder and the first side of the web.

13. Apparatus according to claim 2, wherein the blast air supplied by the first blast air means is controlled using a first valve.

14. Apparatus according to claim 13, wherein the blast air supplied by the second blast air means is controlled using a second valve.

15. Apparatus according to claim 2, wherein a valve is provided for simultaneously controlling said first and second blast air means.

16. Apparatus according to claim 2, wherein air pressure of the blast air supplied by the first blast air means is set to a desired value for floating the web between the first and second blanket cylinders, said desired value being set low enough to prevent web fluttering.

17. Apparatus according to claim 16, wherein air pressure of the blast air supplied by the second blast air means is set to a desired value for floating the web between the first and second blanket cylinders, said desired value being set low enough to prevent web fluttering.

18. Apparatus according to claim 2, further comprising:

means for rotating the first blast air means about an axis essentially parallel to an axis of the first cylinder.

19. Apparatus according to claim 18, further comprising:

means for rotating the second blast air means about an axis essentially parallel to an axis of the second blanket cylinder.

20. Apparatus according to claim 2, further comprising:

additional blast air means provided on the first side of the web for supplying blast air into the first space formed between the first side of the web and the first blanket cylinder.

21. Apparatus according to claim 20, further comprising:

additional blast air means provided on the second side of the web for supplying blast air into the second space formed between the second side of the web and the second blanket cylinder.

* * * * *